US012624840B2

(12) United States Patent
Wu et al.

(10) Patent No.: US 12,624,840 B2
(45) Date of Patent: May 12, 2026

(54) INTEGRATED STOVE

(71) Applicant: FOSHAN SHUNDE MIDEA ELECTRICAL HEATING APPLIANCES MANUFACTURING CO., LIMITED, Foshan (CN)

(72) Inventors: Huimin Wu, Foshan (CN); Guomao Lei, Foshan (CN); Zhiwei Peng, Foshan (CN); Xiaokai Liu, Foshan (CN); Yifan Zhang, Foshan (CN); Taiyang Jiang, Foshan (CN); Yehui Mo, Foshan (CN); Wenhan Xiong, Foshan (CN); Qiangqiang Yang, Foshan (CN); Xingwen Deng, Foshan (CN); Feng Xie, Foshan (CN)

(73) Assignee: FOSHAN SHUNDE MIDEA ELECTRICAL HEATING APPLIANCES MANUFACTURING CO., LIMITED, Foshan (CN)

( * ) Notice: Subject to any disclaimer, the term of this patent is extended or adjusted under 35 U.S.C. 154(b) by 412 days.

(21) Appl. No.: 18/316,251

(22) Filed: May 12, 2023

(65) Prior Publication Data

US 2023/0366561 A1 Nov. 16, 2023

(30) Foreign Application Priority Data

May 13, 2022 (CN) ..... 202210521800.2

(51) Int. Cl.
*F24C 15/20* (2006.01)

(52) U.S. Cl.
CPC ..... *F24C 15/2042* (2013.01); *F24C 15/2035* (2013.01)

(58) Field of Classification Search
CPC ..... F24C 15/2035; F24C 15/2042
See application file for complete search history.

(56) References Cited

U.S. PATENT DOCUMENTS 2,674,991 A * 4/1954 Schaefer ..... F24C 15/2085 126/299 R
4,411,254 A * 10/1983 Field ..... F24C 15/2042 126/300

(Continued)

FOREIGN PATENT DOCUMENTS

CN 111878855 A 11/2020
CN 213931075 U 8/2021

(Continued)

OTHER PUBLICATIONS

First OA received in KR Application No. 10-2023-0061907; mailed Oct. 14, 2024.

(Continued)

*Primary Examiner* — Jorge A Pereiro
(74) *Attorney, Agent, or Firm* — K&L Gates LLP

(57) ABSTRACT

The present application provides an integrated stove. The integrated stove includes: a heating assembly for support and heat a container, and including an air duct; a housing connected to the heating assembly, and including a cavity, where the cavity is communicating with the air duct; and a fan arranged in the cavity, and for extract oil fume by the air duct and the cavity. The air duct and the fan are spaced in a first direction, and the first direction is perpendicular to the height direction of the integrated stove. By spacing the fan and the air duct in the first direction, the problems of a narrow air inlet channel, a large air inlet resistance and a poor oil fume suction effect in the related art are solved. Thus, the effects of optimizing an internal structure layout of the integrated stove, strengthening a capability of the integrated stove to extract oil fume, improving practicability and reliability of the integrated stove, and improving user experience are achieved.

10 Claims, 8 Drawing Sheets

(56) References Cited

U.S. PATENT DOCUMENTS 4,415,788 A * 11/1983 Field ..... H05B 6/1263 219/452.12
4,736,729 A * 4/1988 Beach ..... F24C 15/101 126/300
4,962,694 A * 10/1990 Graver ..... B01D 41/04 126/300
5,001,970 A * 3/1991 Graver ..... F24C 15/2042 126/300
5,078,122 A * 1/1992 Kalenian ..... A47J 37/06 126/299 C
5,482,622 A * 1/1996 Stark ..... B01D 29/111 156/580.2
6,030,173 A * 2/2000 Bacchiocchi ..... F24C 15/20 415/206
6,455,818 B1 * 9/2002 Arntz ..... F24C 15/2042 126/299 R
2007/0023420 A1 * 2/2007 Gagas ..... H05B 6/1263 219/623
2007/0062513 A1 * 3/2007 Gagas ..... G01G 3/16 126/299 D
2010/0163549 A1 * 7/2010 Gagas ..... F24C 15/2042 219/622
2012/0111197 A1 * 5/2012 Weisman ..... B01D 46/0009 55/505
2012/0247345 A1 * 10/2012 Chiang ..... F24C 15/2057 99/357
2016/0296870 A1 * 10/2016 Mckechnie, IV ..... B01D 46/10
2019/0195511 A1 * 6/2019 Neunhäuserer ..... F24C 15/2021
2021/0080109 A1 * 3/2021 Fenton ..... F24C 15/2035
2021/0215350 A1 * 7/2021 Kim ..... F24C 15/2035
2022/0178552 A1 * 6/2022 Flesch ..... F24C 15/2035
2023/0056084 A1 * 2/2023 Chartrel ..... F24C 15/2035

FOREIGN PATENT DOCUMENTS

DE 202013005303 U1 * 6/2013 ..... F24C 15/10
DE 102016123418 A1 6/2018
DE 102019109401 A1 * 10/2020 ..... F24C 15/2042
EP 3855077 A2 7/2021
EP 3916308 A1 12/2021
EP 3978811 A1 4/2022
WO 2017175085 A1 10/2017
WO WO-2019081271 A1 * 5/2019 ..... F24C 15/2035
WO 2022008994 A1 1/2022

OTHER PUBLICATIONS

EESR received in EP Application No. 23173253.8; mailed Nov. 20, 2023.
The first Office Action and search report received in the counterpart CN Application No. 202210521800.2, mailed on Nov. 1, 2025, 13 pages with English translation.

* cited by examiner

INTEGRATED STOVE

The present application claims the benefit and priority of Chinese Patent Application No. 202210521800.2 filed with the China National Intellectual Property Administration on May 13, 2022, and entitled "Integrated stove", which is incorporated in its entirety by reference herein.

FIELD

The present application relates to the field of kitchen utensils, and particularly relates to an integrated stove.

BACKGROUND

In the related art, in order to minimize a space occupied by an integrated stove in a cabinet, the integrated stove is designed with smaller thickness at a main part and higher compactness in a longitudinal structure, which leads to a narrow air inlet channel, a high air inlet resistance, and a poor oil fume suction effect.

Therefore, how to design an integrated stove that can overcome the above defects emerges as an urgent problem to be solved.

SUMMARY

The present application aims to solve at least the problems existing in the prior art.

Thus, the present application provides an integrated stove.

In view of this, the present application provides an integrated stove. The integrated stove includes: a heating assembly for supporting and heating a container, and including an air duct; a housing connected to the heating assembly, and including a cavity, where the cavity is communicating with the air duct; a fan arranged in the cavity, and for extracting oil fume through the air duct and the cavity; and a filter arranged in the cavity, and for filtering the oil fume; where the air duct and the fan are separately arranged in a first direction, the fan and the filter are distributed in the cavity in the first direction, and the first direction is perpendicular to the height direction of the integrated stove.

The present application provides an integrated stove of an internal circulation type. The integrated stove may extract oil fume generated by cooking to the inside of the integrated stove in a concentrated manner, perform oil filtration and odor filtration in the integrated stove and then drain the filtered oil fume back to an indoor environment where a user is located, to achieve internal circulation of oil fume, and avoid a complicated external air exhaust structure.

The integrated stove includes a heating assembly, a filter, a housing, and a fan. The heating assembly is a main structure of the integrated stove, and is for positioning and supporting other structures on the integrated stove. The top of the heating assembly may provide a cooking table for a user, the container for accommodating food material is arranged over the heating assembly, to support and heat the container through the heating assembly. Then a finished food product is cooked on the heating assembly to satisfy needs of the user.

The air duct is formed inside the heating assembly. A first end of the air duct is communicating with a space above the heating assembly. Oil fume is concentratedly generated above the heating assembly during cooking food, and the air duct allows the oil fume above the heating assembly to flow into the integrated stove. The housing is a frame structure of a range hood component, the housing is connected to the heating assembly, a cavity is formed in the housing, and a second end of the air duct is communicating with the cavity. The fan is arranged in the cavity, and the fan may extract oil fume above the heating assembly through the cavity and the air duct. In an embodiment, after the fan is switched on, the fan extracts gas in the air duct into the fan through the cavity, to form a negative pressure environment in a zone of the air duct. Under the action of the negative pressure environment, the oil fume above the heating assembly is compressed into the air duct, to complete driving of the oil fume and prevent the oil fume from diffusing into the indoor environment. The filter is arranged on a windward side of the fan. The oil fume entering the cavity from the air duct needs to pass through the filter first and then is extracted into the fan. The filter is for filtering impurities and substances emitting odor out of the oil fume.

In the related art, in order to guarantee that the integrated stove does not occupy excessive space in a hearth, a thickness of the integrated stove needs to be reduced, and compactness of the integrated stove in the height direction is high, and a corresponding air inlet channel in the integrated stove is forced to narrow. However, an inlet resistance corresponding to the narrowed air inlet channel increases synchronously, resulting in a poor suction effect of the air inlet channel on the oil fume, and the integrated stove cannot satisfy the requirement of extracting oil fume, and then the indoor environment is contaminated by the oil fume, affecting the user experience. In one embodiment, the narrowed air inlet channel further generates large aerodynamic noise, affecting the user experience.

In view of that, the present application optimizes the air inlet channel of the integrated stove. In an embodiment, the air duct and the fan are separately arranged in the first direction. The first direction is perpendicular to the height direction of the integrated stove. During operation, the oil fume extracted into the air duct firstly passes through the heating assembly, then enters the cavity, spreads laterally since the fan is separately arranged from the air duct in the first direction, and is finally collected in the fan. Compared with an embodiment of arranging a fan in a longitudinal direction of an air duct, arrangement the fan and the air duct in the first direction contributes to a reduction in the thickness of the housing, to reduce the difficulty of arranging the integrated stove. Furthermore, a transverse space in the housing may be rationally used, to reduce the air inlet resistance of the air inlet channel composed of the air duct and the cavity, and further to enhance a suction effect of the air inlet channel on the oil fume. Therefore, by spacing the fan and the air duct in the first direction, the problems of a narrow air inlet channel, a large air inlet resistance and a poor oil fume suction effect in the related art are solved. Thus, the effects of optimizing an internal structure layout of the integrated stove, strengthening a capability of the integrated stove to extract oil fume, improving practicability and reliability of the integrated stove, and improving user experience are achieved.

Accordingly, the filter is arranged in the cavity, and the filter and the fan are distributed in the first direction, and the transverse space in the cavity may be rationally used on the basis of not influencing the air inlet effect of the air inlet channel, to complete built-in of the filter on the basis of not increasing the thickness of the integrated stove.

In one embodiment, the filter is arranged on the windward side of the fan, and the impurities contained in the oil fume may be prevented from being extracted into the fan, to reduce a rate of contamination of the fan with impurities, and further to extend a maintenance cycle and service life of the fan. Thus, effects of improving working stability of the integrated stove and reducing a failure rate of the integrated stove are achieved.

The filter removes the odor substances from the oil fume, is usually made of an activated carbon substance, to physically adsorb particles in the oil fume, and may further be a component capable of electric adsorption or liquid adsorption, etc.

Furthermore, the above integrated stove provided in the present application may further have the following additional features.

In the above embodiment, the housing is located below the heating assembly, and the air duct extends in the height direction of the integrated stove.

In this embodiment, a positional relation between the heating assembly and the housing is described. In an embodiment, the housing is arranged below the heating assembly. During integrated stove mounting, the heating assembly is embedded into a mounting opening reserved on the hearth, and an upper surface of the heating assembly serves as a working table. The housing below the heating assembly is shielded by the heating assembly to be hidden in the hearth. When a structure below the heating assembly needs to be cleaned and maintained, a door body of the hearth may be opened for cleaning and maintenance operations.

Accordingly, the air duct in the heating assembly extends in the height direction of the integrated stove. By arranging the air duct extending in the longitudinal direction, the air inlet resistance of the air duct may be reduced to guide the oil fume into the lower cavity conveniently. Furthermore, arranging the air duct extending in the longitudinal direction may reduce occupation of an inner space of the heating assembly by the air duct, to provide convenient conditions for arranging an inner working structure of the heating assembly and facilitate reduction in the thickness of the heating assembly. Thus, an effect of optimizing the structural layout of the integrated stove is achieved.

In any one of the above embodiments, the filter is detachably connected to the housing, and the filter is capable of passing through the air duct.

In this embodiment, on the basis of the foregoing embodiment, the filter arranged in the cavity is detachably connected to the housing, and the filter has a size less than the air duct, and the filter may pass through the air duct. By arranging the detachable filter, the user may remove the filter from the housing when the filter needs to be cleaned or replaced, and then mount the cleaned filter or a new filter, to quickly complete maintenance of the filter. Accordingly, by defining that the filter may pass through the air duct, the user may dismount and mount the filter through the air duct. In an embodiment, a grid at the top of the air duct is removed, and then a hand is extended from the air duct into the cavity, and finally the filter is removed from the air duct. Similarly, a mounting process is facing the dismounting process, which will not be repeated herein.

It can be seen that the filter may be directly maintained above the hearth according to the integrated stove defined in the embodiments, eliminating complicated operations of dismounting a drawer on a cabinet and dismounting an exhaust pipe. Thus, the effects of optimizing the structure layout of the integrated stove, reducing the difficulty in maintenance of the filter, and improving the user experience are achieved.

In any one of the above embodiments, the fan is a centrifugal fan; and an air inlet of the fan is communicating with the cavity, and an air outlet of the fan is provided in the housing.

In this embodiment, the fan is a centrifugal fan, the air inlet of the fan is located in the cavity and is communicating with the cavity, and the air outlet of the fan is formed in the housing, to discharge the oil fume out of the housing. The centrifugal fan may press and accelerate the oil fume extracted into the interior. On one hand, the oil fume may be quickly discharged into the exhaust pipe to which the housing is butted, and on the other hand, the effect of extracting the oil fume is improved, and the fan may satisfy a requirement of extracting a large amount of oil fume. In one embodiment, the centrifugal fan features air extraction at upper and lower end and air exhaust on the peripheral side. The horizontal centrifugal fan may rationally use the transverse space of the cavity. Compared with an axial fan and fans of other types, the centrifugal fan is conducive to reduction in the thickness of the housing, to reduce a space occupied by the integrated stove in the hearth.

In any one of the above embodiments, the fan includes: a fan housing arranged in the cavity, where the air inlet is provided in the fan housing; a wind wheel arranged in the fan housing, where the air inlet is facing an air inlet end of the wind wheel, and the air outlet is located on the peripheral side of the wind wheel; and an motor connected to the wind wheel.

In this embodiment, a structure of the fan is defined on the basis of the above embodiments. In an embodiment, the fan includes a fan housing, a wind wheel, and a motor. The fan housing is a volute, and the fan housing is arranged in the cavity and is connected to an inner wall of the cavity. The air inlet of the fan is formed in the fan housing, and the air outlet formed in the housing is located on the peripheral side of the fan housing. The wind wheel is arranged in the fan housing, and the wind wheel is rotatably connected to the housing. An end face of the wind wheel is arranged facing the air inlet, and the peripheral side face of the wind wheel is arranged facing the air outlet. The motor is mounted on the fan housing, and a power output end of the motor is connected to the wind wheel, to drive the wind wheel to rotate in the fan housing. During operation, a blade on the wind wheel cooperates with the volute to press and accelerate the oil fume, to effectively extract and discharge the oil fume.

The wind wheel provided in the embodiment includes a single-suction wind wheel, that is, oil fume enters the wind wheel from one of an upper end and a lower end of the wind wheel, and is discharged from the peripheral side of the wind wheel under the action of rotation. Correspondingly, a single air inlet is provided in the housing, and the oil fume is extracted into the fan housing through the air inlet. In an embodiment, the fan housing is connected to a top face of the cavity, and the air inlet is separately arranged from a bottom wall of the cavity, to guarantee that the fan does not extract greasy dirt and liquid accumulated at the bottom of the cavity into the fan, to improve the safety of the fan and reducing the failure rate of the fan.

In any one of the above embodiments, the wind wheel is a dual-suction wind wheel; and the air inlet includes a first air inlet and a second air inlet, the first air inlet is facing a first end of the wind wheel, and the second air inlet is facing a second end of the wind wheel.

In this embodiment, the wind wheel further includes a dual-suction wind wheel. That is, oil fume may enter the wind wheel from an upper end and a lower end of the wind wheel, and may be discharged from the peripheral side of the wind wheel under the action of rotation. Correspondingly, the wind wheel is provided with a first air inlet and a second air inlet. The first air inlet is arranged facing the lower end of the dual-suction wind wheel, the second air inlet is arranged facing the upper end of the dual-suction wind wheel, the first air inlet is separately arranged from the bottom wall of the cavity, the second air inlet is separately arranged from a top wall of the cavity, and the fan housing is connected to a side wall of the cavity.

During operation, the oil fume entering the cavity through the air duct is divided in the zone where the fan housing is located. A portion of the oil fume flows into the second air inlet from a space between the top wall of the cavity and an upper surface of the fan housing, and the other portion of the oil fume flows into the first air inlet from a space between the bottom wall of the cavity and a lower surface of the fan housing, and the upper end and the lower end of the fan may extract the oil fume simultaneously. By selecting the dual-suction wind wheel, the capability of the fan to extract oil fume may be increased, and an air volume in the integrated stove may be increased, to guarantee that the integrated stove may adapt to a cooking scene in which a large amount of oil fume is produced. In one embodiment, the up-and-down dividing action of the dual-suction wind wheel on the oil fume may alleviate accumulation of the oil fume at the air inlet, and the oil fume may be more smoothly extracted into the fan housing, to improve the flow fluency of the oil fume and reduce the suction resistance, and further to improve the suction effect of the integrated stove on the oil fume, and aerodynamic noise in the integrated stove may further be reduced, to improve the user experience.

In any one of the above embodiments, the integrated stove further includes a separation assembly arranged in the air duct, and for separating oil from the oil fume.

In this embodiment, a separation assembly is further arranged on the integrated stove, and the separation assembly is arranged in the air duct. During operation, the oil fume flowing into the air duct firstly flows into the separation assembly, and the separation assembly separates oil in the oil fume from air, to prevent the oil from continuously flowing into a range hood together with the air. By arranging the separation assembly, the oil in the oil fume may be prevented from adhering to the inside of the integrated stove, to prevent the oil from clogging the air duct and the filter, and further prevent the oil extracted into the fan from damaging the fan. In one embodiment, the need to frequently clean the oil off from the integrated stove is eliminated. Thus, the problems that the fan is likely to be damaged by greasy dirt and suction of the greasy dirt increases the cleaning burden in the integrated stove are solved.

In any one of the above embodiments, the separation assembly includes a support connected to the heating assembly, and including a gas inlet and a gas outlet; and a filter screen arranged inside the support.

In this embodiment, a structure of the separation assembly is described. In an embodiment, the separation assembly includes a support and a filter screen. The support is connected to the heating assembly, the support is for fixing the filter screen, and a shape of the support matches the air duct, so that the filter screen may be fixed in the air duct. A gas inlet and a gas outlet are formed inside the support. Oil fume carrying oil particles flows into the interior of the support through the gas inlet, and after being separated by the filter screen, the gaseous oil fume is discharged out of the support through the gas outlet. When the oil fume passes through the separation assembly, the oil particles contained in the oil fume are adhered by micropores of the filter screen, and then remain on the filter screen, to achieve an effect of separating the oil and air.

The filter screen may be made of a material that can forma plurality of micropores, that is, the filter screen may capture oil and allow air to pass through. The filter screen may be made of layers of stacked metal flat meshes, metal wire meshes, etc., and may further be made of a material such as a non-metal material mesh.

In any one of the above embodiments, the gas inlet is located at the top of the support, and is communicating with the air duct; and the gas outlet is located on the peripheral side of the support, and is communicating with the cavity.

In this embodiment, the gas inlet of the separation assembly is arranged at the top of the support, to allow oil fume to flow from the top of the separation assembly into the separation assembly. The gas outlet of the separation assembly is arranged on a side of the support, to allow oil fume to be discharged out of the separation assembly from the side surface of the support. In an embodiment, the separation assembly is inserted into the air duct, and the gas inlet at the top of the support is facing an oil fume inlet at the top of the air duct. Oil fume extracted in enters the support from the top of the support, and portion of the support is inserted into the cavity. The oil fume subjected to oil separation is discharged into the cavity from the gas outlet on the peripheral side of the support. It can be seen that providing the gas inlet at the top of the support may match the separation assembly with the vertical air duct, and providing the gas outlet at the side of the support may avoid the separated oil from flowing out of the gas outlet, to achieve the effects of optimizing the structure of the separation assembly and improving the effectiveness and reliability of oil separation.

In any one of the above embodiments, the gas outlet is arranged on one side of the support, the filter is arranged below the support, and the integrated stove further includes: a first baffle arranged between the fan and the support, with the gas outlet facing away from the first baffle; and a second baffle connected to the first baffle, and arranged between the filter and the support.

In this embodiment, a gas outlet is arranged on one side surface of the support, that is, the oil fume subjected to oil separation is discharged from one side of the support. Accordingly, the support is arranged above the filter, and the gas outlet on the support faces away from a direction where the fan is located. The integrated stove further includes a first baffle and a second baffle. The first baffle is connected to the housing, and the first baffle is located between the fan and the support. The second baffle is connected to the first baffle, and the second baffle is located between the support and the lower filter. During insertion of the separation assembly, the gas outlet of the separation assembly faces away from the first baffle, and the separated oil fume may bypass the second baffle and flow into the filter.

By arranging the first baffle and the second baffle, on one hand, oil fume may be prevented from crossing the lower filter and directly flowing into the fan, and on the other hand, the second baffle may deflect the oil fume flowing out of the separation assembly into the filter. During the oil fume deflection, portion of the residual oil not effectively separated by the separation assembly adheres to an inner wall of the cavity under the effect of inertia, to prevent this portion of the residual oil from directly flushing into the separation assembly, and further to reduce the probability that the separation assembly is clogged by oil. Thus, the effects of optimizing a layout of an air path in the integrated stove, prolonging the service life of the filter and reducing the maintenance cost of the integrated stove are achieved.

In any one of the above embodiments, the support includes a first side and a second side that are facing each other, and the first side and the second side are both provided with the gas outlets; and the filter is located between the fan and the support in the first direction.

In this embodiment, on the peripheral side face of the support, gas outlets are arranged on a first side and a second side that facing each other, and in an embodiment, the first side and the second side are a left side and a right side of the filter. The oil fume subjected to oil separation is discharged into the cavity from the left side and the right side of the support. Accordingly, in the first direction, the filter is located between the fan and the support, that is, the filter and the separation assembly are staggered in the height direction of the integrated stove. During operation, the oil fume passing through the filter screen is divided inside the support, and a portion of the oil fume is discharged into the cavity from the gas outlet on the left side of the support and directly flows to the filter. A remaining portion of the oil fume is discharged into the cavity from the gas outlet on the right side of the support and flows into the filter after a flow direction is changed. By providing the gas outlets at both the left side and the right side of the support, a gas flow resistance of the oil fume flowing to the filter may be reduced, the fluency of the oil fume may be improved, and further an air inlet volume may be increased. Thus, the effects of optimizing a structure of the support, improving a capability of the integrated stove to extract oil fume, and improving practicability of the integrated stove are achieved.

In any one of the above embodiments, the support includes an oil reservoir, where the oil reservoir is located below the filter screen.

In this embodiment, an oil reservoir is arranged at the bottom of the support, that is, below the filter screen. When oil adhering to the filter screen increases, the oil may flow along the surface of the filter screen to a lower end of the filter screen and drip into the oil reservoir, and the oil may be stored in the separation assembly. Before the oil reservoir is filled with oil, the user may pour or clear the oil from the oil reservoir by dismounting the separation assembly, to recycle the separation assembly. In an embodiment, a liquid level of the oil may be detected by providing a liquid level sensor on the oil reservoir, and the user can be prompted to clean the oil reservoir in time by an alarm device connected to the liquid level sensor. By arranging the oil reservoir, the separation assembly has a function of collecting and storing oil, which reduces a possibility that oil adheres to the inner wall of the cavity and enters the filter, to extend a cleaning and maintenance cycle of the integrated stove. Thus, the effects of optimizing a structure of the separation assembly, improving the practicability and reliability of the integrated stove, reducing the difficulty in maintaining the integrated stove and improving the user experience are achieved.

In any one of the above embodiments, the heating assembly includes: a base, where the air duct is located in the base, and the housing is connected to the base; and a panel fastened above the base, and including an opening communicating with the air duct.

In this embodiment, the integrated stove further includes a base and a panel. The base is a main frame structure of the integrated stove, and is for positioning and supporting other structures on the integrated stove. The panel is an exposed structure of the integrated stove, and the panel covers the base. After mounting of the integrated stove is completed, a surface of the panel serves as an operating table of the integrated stove. An opening is provided in the panel, and the opening is communicating with the air duct. During operation, a negative pressure is generated in the opening under suction of the fan, and under the action of the negative pressure, oil fume above the panel is compressed into the integrated stove through the opening, to complete collection of the oil fume and prevent the oil fume from diffusing into a room.

The integrated stove further includes a heating device mounted in the base. In an embodiment, the heating device is connected to the panel and the base, and is facing the panel, to form a heating zone on the panel. The heating device may directly heat the panel, to heat a cooking appliance placed on the panel by locally warming the panel up, or the heating device directly heats a cooking appliance placed on a corresponding zone of the panel through the panel. This embodiment does not strictly limit a specific structure of the heating device as long as the heating zone can be formed on the panel.

The bottom of the base is provided with a through hole facing the opening in the panel, an annular member is arranged in the base, an upper end of the annular member is connected to the opening, and a lower end of the annular member is connected to the through hole, to define an air duct in the heating assembly.

In an embodiment, the integrated stove is further provided with a grid. After the assembly of the grid is completed, at least portion of the grid is inserted into the opening. By arranging a grid on the opening, large particulate matter generated during cooking may be prevented from falling into the separation assembly, and accordingly, the particulate matter may be prevented from clogging the gas inlet in the separating assembly. In one embodiment, the grid may prevent external foreign matter such as dust from falling into the separation assembly to an extent, to avoid a large amount of dust and oil from condensing into irremovable lumps. Thus, the effects of improving the working reliability and stability of the separation assembly, reducing the difficulty in cleaning the separation assembly and improving the user experience are achieved.

In any one of the above embodiments, the integrated stove further includes a flue assembly connected to the housing.

In this embodiment, the integrated stove further includes a flue assembly. The flue assembly includes a flue connector and at least one exhaust pipe. When exhaust pipes are provided, the exhaust pipes are connected in series, a first end of the flue connector abuts against the air outlet in the housing, and a second end of the flue connector abuts against a port of an exhaust pipe. By arranging the flue assembly, the oil fume subjected to oil separation and odor filtration may be discharged to a designated zone through the flue assembly. In an embodiment, a longitudinally extending flue assembly may be arranged, and filtered air is discharged close to the ground, which reduces a possibility that the discharged gas interferes with the user. Thus, the practicability and reliability of the integrated stove are improved, and the user experience is optimized.

Additional embodiments of the present application will partially become apparent from the following description, or will be learned by practice of the present application.

BRIEF DESCRIPTION OF THE DRAWINGS

The foregoing and/or additional embodiments of the present application will become apparent and readily appreciated from the following description of the embodiments in conjunction with the accompanying drawings.

Figure 1:
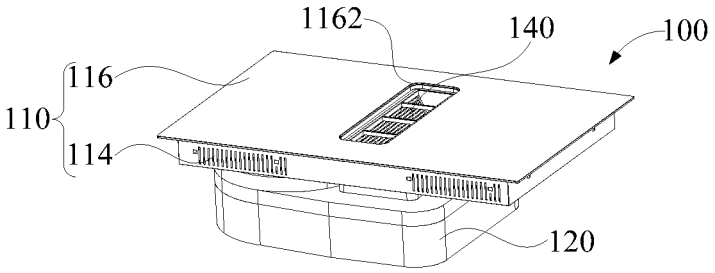
FIG. 1 is a first schematic structural diagram of an integrated stove according to an embodiment of the present application.

Corresponding relations between the reference numerals and component names in FIGS. 1-20 are as follows:

100 integrated stove, 110 heating assembly, 112 air duct, 114 base, 116 panel, 1162 opening, 120 range hood component, 122 housing, 124 cavity, 126 fan, 1262 air inlet, 1263 first air inlet, 1264 second air inlet, 1265 air outlet, 1266 fan housing, 1268 wind wheel, 1269 motor, 130 filter, 140 separation assembly, 142 support, 1422 gas inlet, 1424 gas outlet, 1426 oil reservoir, 144 filter screen, 150 first baffle, and 152 second baffle.

DETAILED DESCRIPTION OF THE DISCLOSURE

The embodiments of the present application will be further described in detail below in conjunction with the accompanying drawings and the specific implementation modes. It is to be noted that the embodiments in the present application and features in the embodiments can be combined without conflicts.

In the following description, numerous specific details are set forth in order to provide a thorough understanding of the present application. However, the present application may be implemented otherwise than as in an embodiment described herein. Accordingly, the scope of protection of the present application is not limited to the specific embodiments disclosed below.

An integrated stove according to some embodiments of the present application is described below with reference to FIGS. 1-20.

Figure 6:
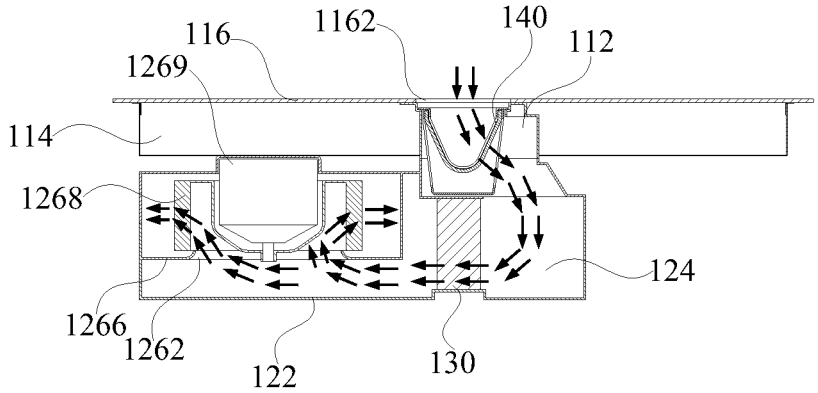
FIG. 6 is a second schematic structural diagram of an integrated stove according to an embodiment of the present application.

As shown in FIGS. 1, 2, 4 and 6, an embodiment of the present application provides an integrated stove 100. The integrated stove 100 includes: a heating assembly 110 for supporting and heating a container, and including an air duct 112; a housing 122 connected to the heating assembly 110, and including a cavity 124, where the cavity 124 is communicating with the air duct 112; and a fan 126 arranged in the cavity 124, and for extracting oil fume through the air duct 112 and the cavity 124. The air duct 112 and the fan 126 are separately arranged in a first direction, and the first direction is perpendicular to the height direction of the integrated stove 100. A direction of an arrow in FIG. 6 is a flowing direction of oil fume.

The present application provides an integrated stove 100 of an internal circulation type. The integrated stove 100 may extract oil fume generated by cooking to the inside of the integrated stove 100 in a concentrated manner, perform oil filtration and odor filtration in the integrated stove 100 and then drain the filtered oil fume back to an indoor environment where a user is located, to achieve internal circulation of oil fume, and avoid a complicated external air exhaust structure.

The integrated stove 100 includes a heating assembly 110, a housing 122, and a fan 126. The heating assembly 110 is a main structure of the integrated stove 100, and is for positioning and supporting other structures on the integrated stove 100. The top of the heating assembly 110 may provide a cooking table for a user, the container for accommodating food material is arranged over the heating assembly 110, to support and heat the container through the heating assembly 110. Then a finished food product is cooked on the heating assembly 110 to satisfy needs of the user.

The air duct 112 is formed inside the heating assembly 110. A first end of the air duct 112 is communicating with a space above the heating assembly 110. Oil fume is concentratedly generated above the heating assembly 110 during cooking food, and the air duct 112 allows the oil fume above the heating assembly 110 to flow into the integrated stove 100. The housing 122 is a frame structure of a range hood component 120, the housing 122 is connected to the heating assembly 110, a cavity 124 is formed in the housing 122, and a second end of the air duct 112 is communicating with the cavity 124. The fan 126 is arranged in the cavity 124, and the fan 126 may extract oil fume above the heating assembly 110 through the cavity 124 and the air duct 112. In an embodiment, after the fan 126 is switched on, the fan 126 extracts gas in the air duct 112 into the fan 126 through the cavity 124, to form a negative pressure environment in a zone of the air duct 112. Under the action of the negative pressure environment, the oil fume above the heating assembly 110 is compressed into the air duct 112, to complete driving of the oil fume and prevent the oil fume from diffusing into the indoor environment.

In the related art, in order to guarantee that the integrated stove does not occupy excessive space in a hearth, a thickness of the integrated stove needs to be reduced, and compactness of the integrated stove in the height direction is high, and a corresponding air inlet channel in the integrated stove is forced to narrow. However, an inlet resistance corresponding to the narrowed air inlet channel increases synchronously, resulting in a poor suction effect of the air inlet channel on the oil fume, and the integrated stove cannot satisfy the requirement of extracting oil fume, and then the indoor environment is contaminated by the oil fume, affecting the user experience. In one embodiment, the narrowed air inlet channel further generates large aerodynamic noise, affecting the user experience.

In view of that, the present application optimizes the air inlet channel of the integrated stove 100. In an embodiment, the air duct 112 and the fan 126 are separately arranged in the first direction. The first direction is perpendicular to the height direction of the integrated stove 100. During operation, the oil fume extracted into the air duct 112 firstly passes through the heating assembly 110, and then enters the cavity 124, and the oil fume entering the cavity 124 spreads laterally since the fan 126 is separately arranged from the air duct 112 in the first direction, and is finally collected in the fan 126. Compared with an implementation solution of arranging a fan in a longitudinal direction of an air duct, arrangement the fan 126 and the air duct 112 in the first direction contributes to a reduction in the thickness of the housing 122, to reduce the difficulty of arranging the integrated stove 100. Furthermore, a transverse space in the housing 122 may be rationally used, to reduce the air inlet resistance of the air inlet channel composed of the air duct 112 and the cavity 124, and further to enhance a suction effect of the air inlet channel on the oil fume.

Therefore, by spacing the fan 126 and the air duct 112 in the first direction, the problems of a narrow air inlet channel, a large air inlet resistance and a poor oil fume suction effect in the related art are solved. Thus, the effects of optimizing an internal structure layout of the integrated stove 100, strengthening a capability of the integrated stove 100 to extract oil fume, improving practicability and reliability of the integrated stove 100, and improving user experience are achieved.

Figure 3:
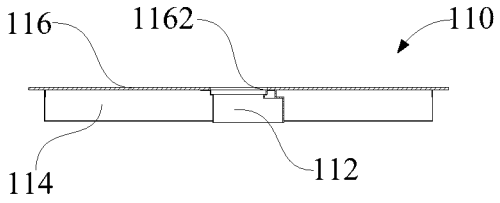
FIG. 3 is a schematic structural diagram of a heating assembly according to an embodiment of the present application.

As shown in FIGS. 3 and 6, the housing 122 is located below the heating assembly 110, and the air duct 112 extends in the height direction of the integrated stove 100.

In this embodiment, a positional relation between the heating assembly 110 and the housing 122 is described. In an embodiment, the housing 122 is arranged below the heating assembly 110. During integrated stove 100 mounting, the heating assembly 110 is embedded into a mounting opening reserved on the hearth, and an upper surface of the heating assembly 110 serves as a working table. The housing 122 below the heating assembly 110 is shielded by the heating assembly 110 to be hidden in the hearth. When a structure below the heating assembly 110 needs to be cleaned and maintained, a door body of the hearth may be opened for cleaning and maintenance operations.

Accordingly, the air duct 112 in the heating assembly 110 extends in the height direction of the integrated stove 100. By arranging the air duct 112 extending in the longitudinal direction, the air inlet resistance of the air duct 112 may be reduced to guide the oil fume into the lower cavity 124 conveniently. Furthermore, arranging the air duct 112 extending in the longitudinal direction may reduce occupation of an inner space of the heating assembly 110 by the air duct 112, to provide convenience for arranging an inner working structure of the heating assembly 110 and facilitate reduction in the thickness of the heating assembly 110. Thus, an effect of optimizing the structural layout of the integrated stove 100 is achieved.

Figure 11:
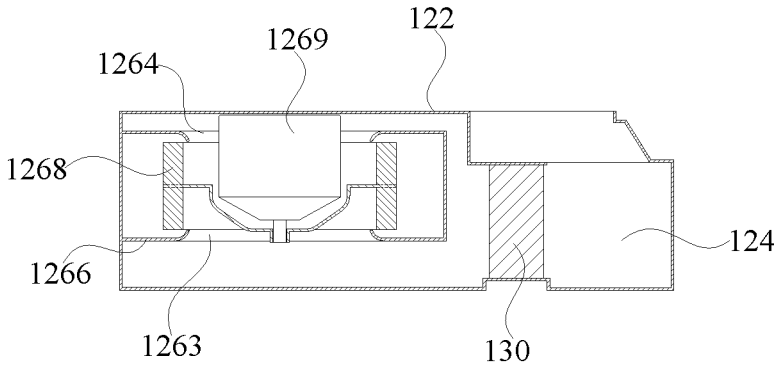
FIG. 11 is a fourth schematic structural diagram of a range hood component according to an embodiment of the present application.
Figure 12:
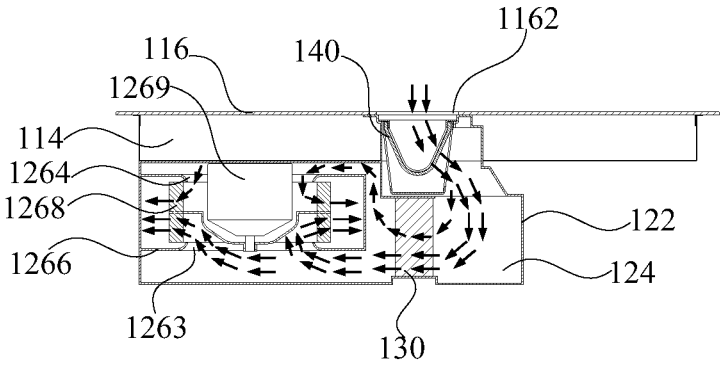
FIG. 12 is a fourth schematic structural diagram of an integrated stove according to an embodiment of the present application.
Figure 17:
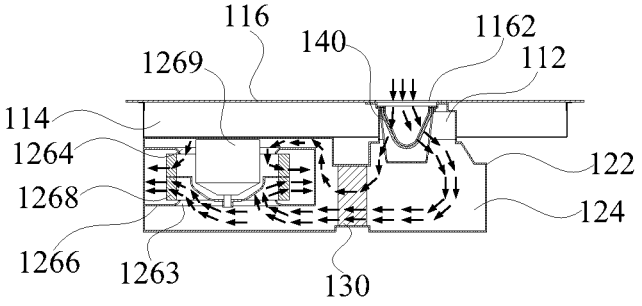
FIG. 17 is a fifth schematic structural diagram of an integrated stove according to an embodiment of the present application.

As shown in FIGS. 5, 6, 11, 12 and 17, in an embodiment of the present application, the integrated stove 100 further includes a filter 130 arranged in the cavity 124, located between the air duct 112 and the fan 126, and for filtering oil fume. A direction of an arrow in FIG. 12 is a flowing direction of oil fume. A direction of an arrow in FIG. 17 is a flowing direction of oil fume.

In this embodiment, the integrated stove 100 is further provided with a filter 130. The filter 130 is for filtering the oil fume extracted into the integrated stove 100, to filter out impurities contained in the oil fume and odor substances. Thus, it is guaranteed that gas finally discharged back into the room does not pollute the indoor environment.

In the related art, in order to simplify a product structure, the filter is generally mounted in an exhaust pipe in a cabinet, but when the filter needs to be cleaned or replaced, a user needs to remove a drawer of the cabinet and remove the exhaust pipe to complete the cleaning and replacement operation, and the integrated stove has the problems that the filter is difficult to dismount or mount and maintenance and operation by the user is complicated. In one embodiment, since filters produced by different manufacturers have different sizes, corresponding matching exhaust pipes have different sizes, and then different brands and different models of products cannot form a unified exhaust pipe standard. Accordingly, a user can only purchase an exhaust pipe of a corresponding brand and a corresponding model when mounting or replacing the exhaust duct, causing the cost of maintaining the exhaust duct to increase, which is not conducive to promotion of the product.

In view of that, in the present application, the filter 130 is arranged in the cavity 124 in the housing 122, and the filter 130 is arranged on a windward side of the fan 126, that is, the filter 130 is located between the air duct 112 and the fan 126, and oil fume entering the cavity 124 from the air duct 112 needs to pass through the filter 130 at first before being extracted into the fan 126. By arranging the filter 130 in the cavity 124, restriction on the size of the exhaust pipe by the filter 130 may be removed, allowing the fan 126 to be connected to exhaust pipes of different models and manufacturers, to reduce the cost of maintaining the integrated stove 100 by the user, and to facilitate a uniform exhaust pipe standard across brands. In one embodiment, on the basis of the foregoing embodiments, arranging the filter 130 in the cavity 124 may rationally use a transverse space in the cavity 124, to arrange the filter 130 internally without increasing the thickness of the integrated stove 100. It can be seen that by arranging the filter 130 in the transverse space of the cavity 124, the problems of high maintenance cost and poor popularization of the integrated stove in the related art are solved. The effects of optimizing a structure layout of the integrated stove 100, improving practicability of the integrated stove 100, and improving user experience are achieved.

In one embodiment, the filter 130 is arranged on the windward side of the fan 126, and the impurities contained in the oil fume may be prevented from being extracted into the fan 126, to reduce a rate of contamination of the fan 126 with impurities, and further to extend a maintenance cycle and service life of the fan 126. Thus, effects of improving working stability of the integrated stove 100 and reducing a failure rate of the integrated stove 100 are achieved.

The filter 130 removes the odor substances from the oil fume, is usually made of an activated carbon substance, to physically adsorb particles in the oil fume, and may further be a component capable of electric adsorption or liquid adsorption, etc.

Figure 7:
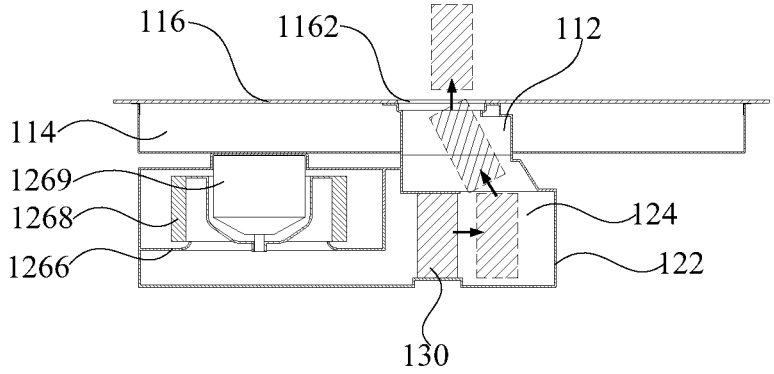
FIG. 7 is a third schematic structural diagram of an integrated stove according to an embodiment of the present application.
Figure 18:
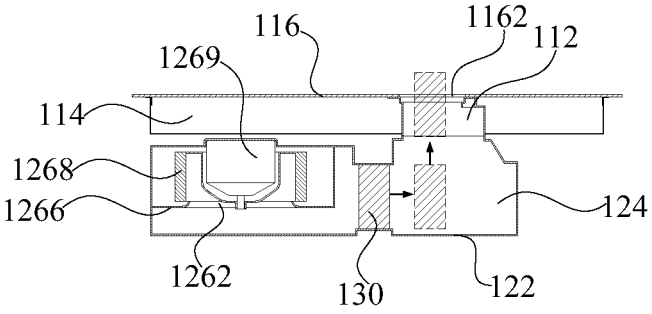
FIG. 18 is a sixth schematic structural diagram of an integrated stove according to an embodiment of the present application.

As shown in FIGS. 7 and 18, in any one of the above embodiments, the filter 130 is detachably connected to the housing 122, and the filter 130 is capable of passing through the air duct 112. A direction of an arrow in FIG. 7 is a direction of removing the filter 130. A direction of an arrow in FIG. 18 is a direction of removing the filter 130.

In this embodiment, on the basis of the foregoing embodiment, the filter 130 arranged in the cavity 124 is detachably connected to the housing 122, and the filter 130 has a size less than the air duct 112, and the filter 130 may pass through the air duct 112. By arranging the detachable filter 130, the user may remove the filter 130 from the housing 122 when the filter 130 needs to be cleaned or replaced, and then mount the cleaned filter 130 or a new filter 130, to quickly complete maintenance of the filter 130. Accordingly, by defining that the filter 130 may pass through the air duct 112, the user may dismount and mount the filter 130 through the air duct 112. In an embodiment, a grid at the top of the air duct 112 is removed, and then a hand is extended from the air duct 112 into the cavity 124, and finally the filter 130 is removed from the air duct 112. Similarly, a mounting process is opposite to the dismounting process, which will not be repeated herein.

It can be seen that the filter 130 may be directly maintained above the hearth according to the integrated stove 100 defined in the embodiment, eliminating complicated operations of dismounting a drawer on a cabinet and dismounting an exhaust pipe. Thus, the effects of optimizing the structure layout of the integrated stove 100, reducing the difficulty in maintenance of the filter 130, and improving the user experience are achieved.

Figure 8:
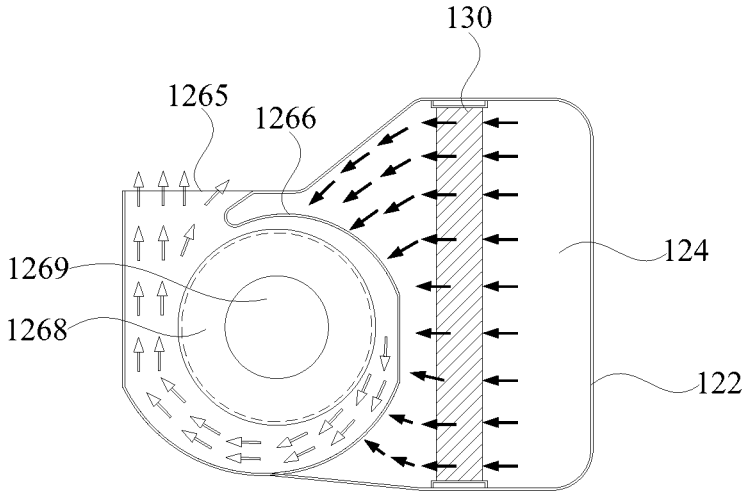
FIG. 8 is a third schematic structural diagram of a range hood component according to an embodiment of the present application.

As shown in FIG. 8, in an embodiment of the present application, the fan 126 is a centrifugal fan; and an air inlet 1262 of the fan 126 is communicating with the cavity 124, and an air outlet 1265 of the fan 126 is provided in the housing 122. A direction of an arrow in FIG. 8 is a flowing direction of oil fume in the housing 122.

In this embodiment, the fan 126 is a centrifugal fan, the air inlet 1262 of the fan 126 is located in the cavity 124 and is communicating with the cavity 124, and the air outlet 1265 of the fan 126 is formed in the housing 122, to discharge the oil fume out of the housing 122. The centrifugal fan may press and accelerate the oil fume extracted into the interior. On one hand, the oil fume may be quickly discharged into the exhaust pipe to which the housing 122 is butted, and on the other hand, the suction effect on the oil fume is improved, and the fan 126 may satisfy a requirement of extracting a large amount of oil fume. In one embodiment, the centrifugal fan features air extraction at upper and lower end and air exhaust on the peripheral side. The horizontal centrifugal fan may rationally use the transverse space of the cavity 124. Compared with an axial fan and fans of other types, the centrifugal fan is conducive to reduction in the thickness of the housing 122, to reduce a space occupied by the integrated stove 100 in the hearth.

Figure 5:
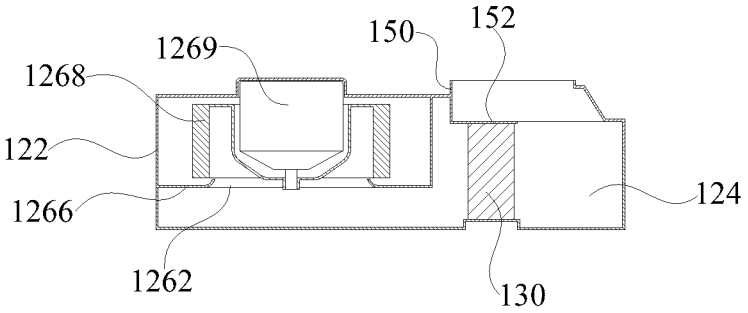
FIG. 5 is a second schematic structural diagram of a range hood component according to an embodiment of the present application.
Figure 19:
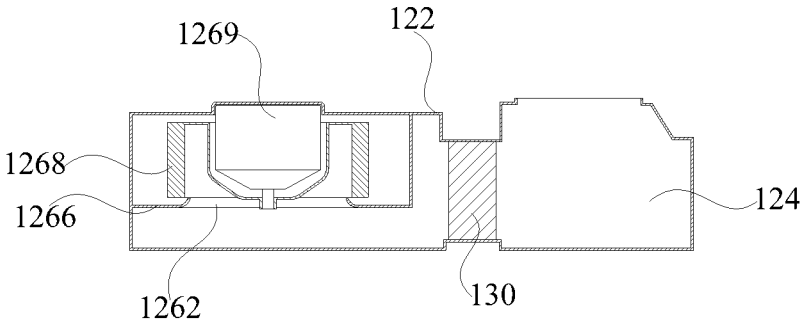
FIG. 19 is a fifth schematic structural diagram of a range hood component according to an embodiment of the present application.
Figure 20:
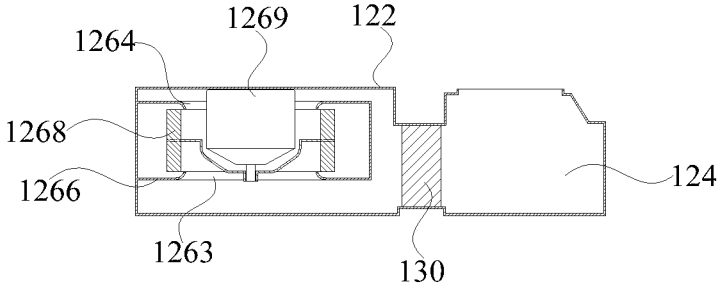
FIG. 20 is a sixth schematic structural diagram of a range hood component according to an embodiment of the present application.

As shown in FIGS. 5, 11 and 19, in any one of the above embodiments, the fan 126 includes: a fan housing 1266 arranged in the cavity 124, where the air inlet 1262 is provided in the fan housing 1266; a wind wheel 1268 arranged in the fan housing 1266, where the air inlet 1262 is facing an air inlet end of the wind wheel 1268, and the air outlet 1265 is located on the peripheral side of the wind wheel 1268; and an motor 1269 connected to the wind wheel 1268.

In this embodiment, a structure of the fan 126 is defined on the basis of the above embodiments. In an embodiment, the fan 126 includes a fan housing 1266, a wind wheel 1268, and a motor 1269. The fan housing 1266 is a volute, and the fan housing 1266 is arranged in the cavity 124 and is connected to an inner wall of the cavity 124. The air inlet 1262 of the fan 126 is formed in the fan housing 1266, and the air outlet 1265 formed in the housing 122 is located on the peripheral side of the fan housing 1266. The wind wheel 1268 is arranged in the fan housing 1266, and the wind wheel 1268 is rotatably connected to the housing 1266. An end face of the wind wheel 1268 is arranged facing the air inlet 1262, and the peripheral side face of the wind wheel 1268 is arranged facing the air outlet 1265. The motor 1269 is mounted on the fan housing 1266, and a power output end of the motor 1269 is connected to the wind wheel 1268, to drive the wind wheel 1268 to rotate in the fan housing 1266. During operation, a blade on the wind wheel 1268 cooperates with the volute to compress and accelerate the oil fume, to efficiently extract and discharge the oil fume.

Figure 9:
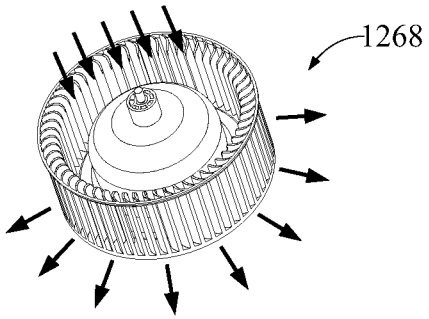
FIG. 9 is a first schematic structural diagram of a wind wheel according to an embodiment of the present application.
Figure 10:
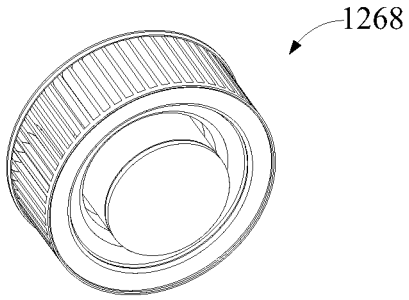
FIG. 10 is a second schematic structural diagram of a wind wheel according to an embodiment of the present application.

As shown in FIGS. 9 and 10, the wind wheel 1268 provided in the embodiment includes a single-suction wind wheel, that is, oil fume enters the wind wheel 1268 from one of an upper end and a lower end of the wind wheel 1268, and is discharged from the peripheral side of the wind wheel 1268 under the action of rotation. A direction of an arrow in FIG. 9 is a flowing direction of oil fume on the single-suction wind wheel. Correspondingly, a single air inlet 1262 is provided in the housing 1266, and the oil fume is extracted into the fan housing 1266 through the air inlet 1262. In an embodiment, the fan housing 1266 is connected to a top face of the cavity 124, and the air inlet 1262 is separately arranged from a bottom wall of the cavity 124, to guarantee that the fan 126 does not extract greasy dirt and liquid accumulated at the bottom of the cavity 124 into the fan 126, to improve the safety of the fan 126 and reducing the failure rate of the fan 126.

Figure 13:
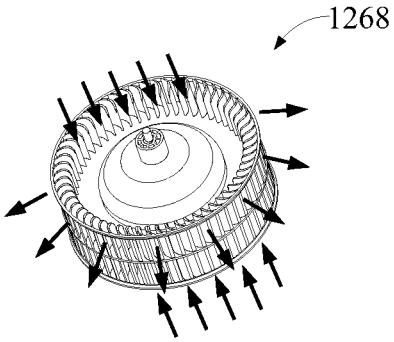
FIG. 13 is a third schematic structural diagram of a wind wheel according to an embodiment of the present application.
Figure 14:
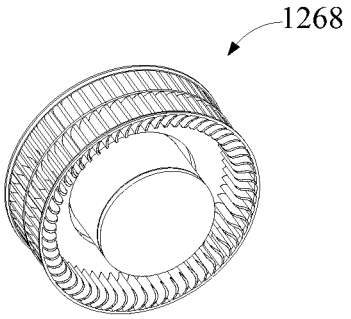
FIG. 14 is a fourth schematic structural diagram of a wind wheel according to an embodiment of the present application.

As shown in FIGS. 11, 12, 13, 14 and 20, in any one of the above embodiments, the wind wheel 1268 is a dual-suction wind wheel; and the air inlet 1262 includes a first air inlet 1263 and a second air inlet 1264, the first air inlet 1263 is facing a first end of the wind wheel 1268, and the second air inlet 1264 is facing a second end of the wind wheel 1268. A direction of an arrow in FIG. 13 is a flowing direction of oil fume on the dual-suction wind wheel.

In this embodiment, the wind wheel 1268 further includes a dual-suction wind wheel, that is, oil fume may enter the wind wheel 1268 from an upper end and a lower end of the wind wheel 1268, and may be discharged from the peripheral side of the wind wheel 1268 under the action of rotation. Correspondingly, the housing 122 is provided with a first air inlet 1263 and a second air inlet 1264. The first air inlet 1263 is arranged facing the lower end of the dual-suction wind wheel, the second air inlet 1264 is arranged facing the upper end of the dual-suction wind wheel, the first air inlet 1263 is separately arranged from the bottom wall of the cavity 124, the second air inlet 1264 is separately arranged from a top wall of the cavity 124, and the fan housing 1266 is connected to a side wall of the cavity 124.

During operation, the oil fume entering the cavity 124 through the air duct 112 is divided in the zone where the fan housing 1266 is located. A portion of the oil fume flows into the second air inlet 1264 from a space between the top wall of the cavity 124 and an upper surface of the fan housing 1266, and the other portion of the oil fume flows into the first air inlet 1263 from a space between the bottom wall of the cavity 124 and a lower surface of the fan housing 1266, and the upper end and the lower end of the fan 126 may extract the oil fume simultaneously. By selecting the dual-suction wind wheel, the capability of the fan 126 to extract oil fume may be increased, and an air volume in the integrated stove 100 may be increased, to guarantee that the integrated stove 100 may adapt to a cooking scene in which a large amount of oil fume is produced. In one embodiment, the up-and-down dividing action of the dual-suction wind wheel on the oil fume may alleviate accumulation of the oil fume at the air inlet 1262, and the oil fume may be more smoothly extracted into the fan housing 1266, to improve the flow fluency of the oil fume and reduce the suction resistance, and further to improve the suction effect of the integrated stove 100 on the oil fume, and aerodynamic noise in the integrated stove 100 may further be reduced, to improve the user experience.

Figure 15:
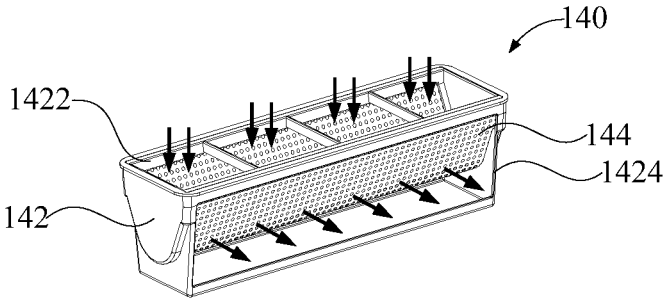
FIG. 15 is a first schematic structural diagram of a separation assembly according to an embodiment of the present application.
Figure 16:
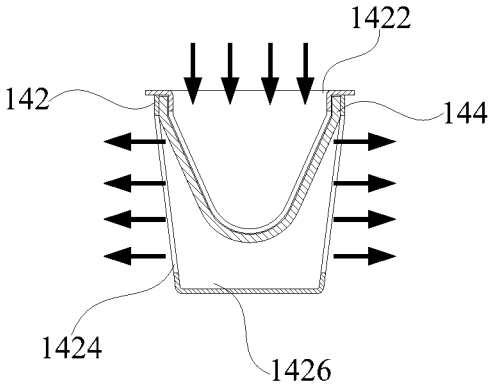
FIG. 16 is a second schematic structural diagram of a separation assembly according to an embodiment of the present application.

As shown in FIGS. 2, 6, 15 and 16, in any one of the above embodiments, the integrated stove 100 further includes a separation assembly 140 arranged in the air duct 112, and for separating oil from the oil fume. Directions of arrows in FIGS. 15 and 16 are a flowing direction of oil fume on the separation assembly 140.

In this embodiment, a separation assembly is further arranged on the integrated stove 100, and the separation assembly is arranged in the air duct 112. During operation, the oil fume flowing into the air duct 112 firstly flows into the separation assembly, and the separation assembly separates oil in the oil fume from air, to prevent the oil from continuously flowing into a range hood together with the air. By arranging the separation assembly, the oil in the oil fume may be prevented from adhering to an internal working structure of the integrated stove 100, to prevent the oil from clogging the air duct 112 and the filter 130, and further prevent the oil extracted into the fan 126 from damaging the fan 126. In one embodiment, the need to frequently clean the oil off from the integrated stove 100 is eliminated. Thus, the problems that the fan is likely to be damaged by greasy dirt and suction of the greasy dirt increases the cleaning burden in the integrated stove are solved.

As shown in FIGS. 15 and 16, in any one of the above embodiments, the separation assembly 140 includes: a support 142 connected to the heating assembly 110, and including a gas inlet 1422 and a gas outlet 1424; and a filter screen 144 arranged inside the support 142.

In this embodiment, a structure of the separation assembly 140 is described. In an embodiment, the separation assembly 140 includes a support 142 and a filter screen 144. The support 142 is connected to the heating assembly 110, the support 142 is for fixing the filter screen 144, and a shape of the support 142 matches the air duct 112, so that the filter screen 144 may be fixed in the air duct 112. A gas inlet 1422 and a gas outlet 1424 are formed inside the support 142. Oil fume carrying oil particles flows into the interior of the support 142 through the gas inlet 1422, and after being separated by the filter screen 144, the gaseous oil fume is discharged out of the support 142 through the gas outlet 1424. When the oil fume passes through the separation assembly 140, the oil particles contained in the oil fume are adhered by micropores of the filter screen 144, and then remain on the filter screen 144, to achieve an effect of separating the oil and air.

The filter screen 144 may be made of a material that can form micropores, that is, the filter screen 144 may capture oil and allow air to pass through. The filter screen may be made of layers of stacked metal flat meshes, metal wire meshes, etc., and may further be made of a material such as a non-metal material mesh.

As shown in FIGS. 5 and 6, in any one of the above embodiments, the gas inlet 1422 is located at the top of the support 142, and is communicating with the air duct 112; and the gas outlet 1424 is located on the peripheral side of the support 142, and is communicating with the cavity 124.

In this embodiment, the gas inlet 1422 of the separation assembly 140 is arranged at the top of the support 142, to allow oil fume to flow from the top of the separation assembly 140 into the separation assembly 140. The gas outlet 1424 of the separation assembly 140 is arranged on a side of the support 142, to allow oil fume to be discharged out of the separation assembly 140 from the side surface of the support 142. In an embodiment, the separation assembly 140 is inserted into the air duct 112, and the gas inlet 1422 at the top of the support 142 is facing an oil fume inlet at the top of the air duct 112. Oil fume extracted in enters the support 142 from the top of the support 142, and portion of the support 142 is inserted into the cavity 124. The oil fume subjected to oil separation is discharged into the cavity 124 from the gas outlet 1424 on the peripheral side of the support 142. It can be seen that providing the gas inlet 1422 at the top of the support 142 may match the separation assembly 140 with the vertical air duct 112, and providing the gas outlet 1424 at the side of the support 142 may avoid the separated oil from flowing out of the gas outlet 1424, to achieve the effects of optimizing the structure of the separation assembly 140 and improving the effectiveness and reliability of oil separation.

As shown in FIGS. 5 and 6, in any one of the above embodiments, the gas outlet 1424 is arranged on one side of the support 142, the filter 130 is arranged below the support 142, and the integrated stove 100 further includes: a first baffle 150 arranged between the fan 126 and the support 142, with the gas outlet 1424 facing away from the first baffle 150; and a second baffle 152 connected to the first baffle 150, and arranged between the filter 130 and the support 142.

In this embodiment, a gas outlet 1424 is arranged on one side surface of the support 142, that is, the oil fume subjected to oil separation is discharged from one side of the support 142. Accordingly, the support 142 is arranged above the filter 130, and the gas outlet 1424 on the support 142 faces away from a direction where the fan 126 is located. The integrated stove 100 further includes a first baffle 150 and a second baffle 152. The first baffle 150 is connected to the housing 122, and the first baffle 150 is located between the fan 126 and the support 142. The second baffle 152 is connected to the first baffle 150, and the second baffle 152 is located between the support 142 and the lower filter 130. During insertion of the separation assembly 140, the gas outlet 1424 of the separation assembly 140 faces away from the first baffle 150, and the separated oil fume may bypass the second baffle 152 and flow into the filter 130.

By arranging the first baffle 150 and the second baffle 152, on one hand, oil fume may be prevented from crossing the lower filter 130 and directly flowing into the fan 126, and on the other hand, the second baffle 152 may deflect the oil fume flowing out of the separation assembly 140 into the filter 130. During the oil fume deflection, portion of the residual oil not effectively separated by the separation assembly 140 adheres to an inner wall of the cavity 124 under the effect of inertia, to prevent this portion of the residual oil from directly flushing into the separation assembly, and further to reduce the probability that oil clogs the separation assembly. Thus, the effects of optimizing a layout of an air path in the integrated stove 100, prolonging the service life of the filter 130 and reducing the maintenance cost of the integrated stove 100 are achieved.

As shown in FIGS. 11 and 12, in any one of the above embodiments, the support 142 includes a first side and a second side that are facing each other, and the first side and the second side are both provided with the gas outlets 1424; and the filter 130 is located between the fan 126 and the support 142 in the first direction.

In this embodiment, on the peripheral side face of the support 142, gas outlets 1424 are arranged on a first side and a second side that facing each other, and in an embodiment, the first side and the second side are a left side and a right side of the filter 130. The oil fume subjected to oil separation is discharged into the cavity 124 from the left side and the right side of the support 142. Accordingly, in the first direction, the filter 130 is located between the fan 126 and the support 142, that is, the filter 130 and the separation assembly 140 are staggered in the height direction of the integrated stove 100. During operation, the oil fume passing through the filter screen 144 is divided inside the support 142, and a portion of the oil fume is discharged into the cavity 124 from the gas outlet 1424 on the left side of the support 142 and directly flows to the filter 130. A remaining portion of the oil fume is discharged into the cavity 124 from the gas outlet 1424 on the right side of the support 142 and flows into the filter 130 after a flow direction is changed. By providing the gas outlets 1424 at both the left side and the right side of the support 142, a gas flow resistance of the oil fume flowing to the filter 130 may be reduced, the fluency of the oil fume may be improved, and further an air inlet volume may be increased. Thus, the effects of optimizing a structure of the support 142, improving a capability of the integrated stove 100 to extract oil fume, and improving practicability of the integrated stove 100 are achieved.

As shown in FIGS. 15 and 16, in any one of the above embodiments, the support 142 includes an oil reservoir 1426, where the oil reservoir 1426 is located below the filter screen 144.

In this embodiment, an oil reservoir 1426 is arranged at the bottom of the support 142, that is, below the filter screen 144. When oil adhering to the filter screen 144 increases, the oil may flow along the surface of the filter screen 144 to a lower end of the filter screen 144 and drip into the oil reservoir 1426, and the oil may be stored in the separation assembly 140. Before the oil reservoir 1426 is filled with oil, the user may pour or clear the oil from the oil reservoir 1426 by dismounting the separation assembly 140, to recycle the separation assembly 140. In an embodiment, a liquid level of the oil may be detected by providing a liquid level sensor on the oil reservoir 1426, and the user can be prompted to clean the oil reservoir 1426 in time by an alarm device connected to the liquid level sensor. By arranging the oil reservoir 1426, the separation assembly 140 has a function of collecting and storing oil, which reduces a possibility that oil adheres to the inner wall of the cavity 124 and enters the filter 130, to extend a cleaning and maintenance cycle of the integrated stove 100. Thus, the effects of optimizing a structure of the separation assembly 140, improving the practicability and reliability of the integrated stove 100, reducing the difficulty in maintaining the integrated stove 100 and improving the user experience are achieved.

Figure 2:
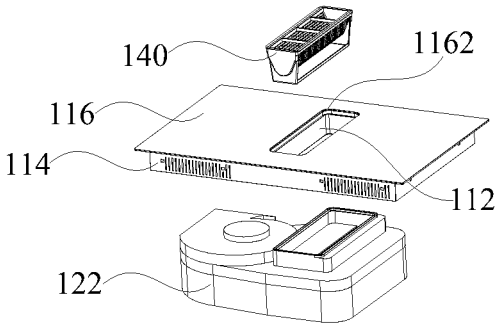
FIG. 2 is an explosive view of an integrated stove according to an embodiment of the present application.
Figure 4:
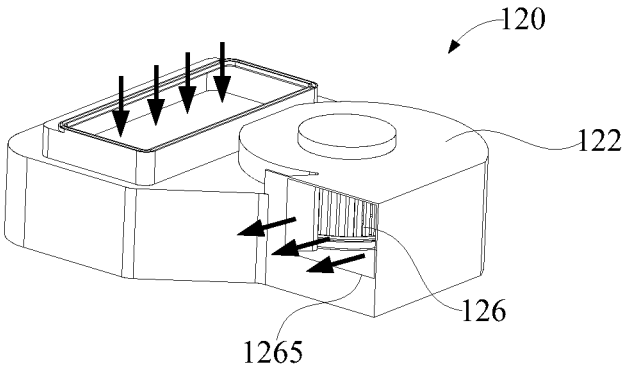
FIG. 4 is a first schematic structural diagram of a range hood component according to an embodiment of the present application.

As shown in FIGS. 2, 3 and 4, in any one of the above embodiments, the heating assembly 110 includes: a base 114, where the air duct 112 is located in the base 114, and the housing 122 is connected to the base 114; and a panel 116 fastened above the base 114, and including an opening 1162 communicating with the air duct 112. A direction of an arrow in FIG. 4 is a flowing direction of oil fume on a range hood component 120.

In this embodiment, the integrated stove 100 further includes a base 114 and a panel 116. The base 114 is a main frame structure of the integrated stove 100, and is for positioning and supporting other structures on the integrated stove 100. The panel 116 is an exposed structure of the integrated stove 100, and the panel 116 covers the base 114. After mounting of the integrated stove 100 is completed, a surface of the panel 116 serves as an operating table of the integrated stove 100. An opening 1162 is provided in the panel 116, and the opening 1162 is communicating with the air duct 112. During operation, a negative pressure is generated in the opening 1162 under suction of the fan 126, and under the action of the negative pressure, oil fume above the panel 116 is compressed into the integrated stove 100 through the opening 1162, to complete collection of the oil fume and prevent the oil fume from diffusing into a room.

The integrated stove 100 further includes a heating device mounted in the base 114. In an embodiment, the heating device is connected to the panel 116 and the base 114, and is facing the panel 116, to form a heating zone on the panel 116. The heating device may directly heat the panel 116, to heat a cooking appliance placed on the panel 116 by locally warming the panel 116 up, or the heating device directly heats a cooking appliance placed on a corresponding zone of the panel 116 through the panel 116. This embodiment does not strictly limit a specific structure of the heating device as long as the heating zone can be formed on the panel 116.

The bottom of the base 114 is provided with a through hole facing the opening 1162 in the panel 116, an annular member is arranged in the base 114, an upper end of the annular member is connected to the opening 1162, and a lower end of the annular member is connected to the through hole, to define an air duct 112 in the heating assembly 110.

In an embodiment, the integrated stove 100 is further provided with a grid. After the assembly of the grid is completed, at least portion of the grid is inserted into the opening 1162. By arranging a grid on the opening 1162, large particulate matter generated during cooking may be prevented from falling into the separation assembly 140, and accordingly, the particulate matter may be prevented from clogging the gas inlet 1422 in the separating assembly 140. In one embodiment, the grid may prevent external foreign matter such as dust from falling into the separation assembly 140 to an extent, to avoid a large amount of dust and oil from condensing into irremovable lumps. Thus, the effects of improving the working reliability and stability of the separation assembly 140, reducing the difficulty in cleaning the separation assembly 140 and improving the user experience are achieved.

In any one of the above embodiments, the integrated stove 100 further includes a flue assembly connected to the housing 122.

In this embodiment, the integrated stove 100 further includes a flue assembly. The flue assembly includes a flue connector and at least one exhaust pipe. When exhaust pipes are provided, the exhaust pipes are connected in series, a first end of the flue connector abuts against the air outlet 1265 in the housing 122, and a second end of the flue connector abuts against a port of an exhaust pipe. By arranging the flue assembly, the oil fume subjected to oil separation and odor filtration may be discharged to a designated zone through the flue assembly. In an embodiment, a longitudinally extending flue assembly may be arranged, and filtered air is discharged close to the ground, which reduces a possibility that the discharged gas interferes with the user. Thus, the practicability and reliability of the integrated stove 100 are improved, and the user experience is optimized.

It is to be noted that in the claims, specification and drawings of the specification of the present application, the term "plurality" means two or more. Unless otherwise in an embodiment limited, the terms "upper", "lower", etc. indicate azimuthal or positional relations based on those shown in the drawings only for ease of description of the present application and for simplicity of a description process, are not intended to indicate or imply that the referenced device or element must have a particular orientation and be constructed and operative in a particular orientation, and thus may not be construed as a limitation on the present application. The terms "connect", "mount", "fix", etc. are to be construed in a broad sense. For example, "connect" may be a fixed connection between objects, a detachable connection between objects, or an integral connection, and may be a direct connection between objects, or an indirect connection between objects through an intermediary.

In the claims, specification and drawings of the specification of the present application, the description of the terms "an embodiment", "some embodiments", "a particular embodiment", etc. means that the particular features, structures, materials, or characteristics described with reference to the embodiment or example are included in at least one embodiment or example of the present application. In the claims, specification and drawings of the specification of the present application, the schematic descriptions of the above terms do not necessarily refer to the same embodiment or example. Moreover, the particular features, structures, materials, or characteristics described may be combined in any suitable way in any one or more embodiments or examples.

What are described above are merely some embodiments of the present application and are not intended to limit the present application, and various changes and modifications may be made to the present application.

What is claimed is:

1. An integrated stove, comprising:

a heating assembly configured to support and heat a container, including an air duct;

a housing connected to the heating assembly, including a cavity that is in communication with the air duct;

a fan arranged in the cavity configured to extract oil fume through the air duct and the cavity;

a filter arranged in the cavity configured to filter the oil fume;

a separation assembly arranged in the air duct, and configured to separate grease from the oil fume;

a first baffle arranged between the fan and the separation assembly; and a second baffle connected to the first baffle, and arranged between the filter and the separation assembly;

wherein the air duct and the fan are separately arranged in a first direction, the fan and the filter are distributed in the cavity along the first direction, which is perpendicular to a vertical direction of the integrated stove, wherein the separation assembly comprises:

a support connected to the heating assembly, and comprising a gas inlet and a gas outlet; and a filter screen arranged inside the support, the gas inlet is located at a top of the support and is in communication with the air duct; and the gas outlet is located on a peripheral side of the support and is in communication with the cavity, wherein the gas outlet is arranged on one side of the support, the filter is arranged below the support;

the first baffle is arranged between the fan and the support, with the gas outlet facing away from the first baffle; and the second baffle is arranged between the filter and the support.

2. The integrated stove according to claim 1, wherein the housing is located below the heating assembly, and the air duct extends in the vertical direction of the integrated stove.

3. The integrated stove according to claim 1, wherein the filter is detachably connected to the housing, and the filter is capable of passing through the air duct.

4. The integrated stove according to claim 1, wherein the fan is a centrifugal fan; and an air inlet of the fan is in communication with the cavity, and an air outlet of the fan is provided on the housing.

5. The integrated stove according to claim 4, wherein the fan comprises:

a fan housing arranged in the cavity, wherein the air inlet is provided in the fan housing;

a wind wheel arranged in the fan housing, wherein the air inlet is opposite an air inlet end of the wind wheel, and the air outlet is located on a peripheral side of the wind wheel; and a motor connected to the wind wheel.

6. The integrated stove according to claim 5, wherein the wind wheel is a dual-suction wind wheel; and the air inlet comprises a first air inlet facing a first end of the wind wheel and a second air inlet facing a second end of the wind wheel.

7. The integrated stove according to claim 1, wherein the support comprises a first side and a second side that are opposite each other, and the first side and the second side are both provided with gas outlets; and the filter is located between the fan and the support in the first direction.

8. The integrated stove according to claim 1, wherein the support comprises an oil reservoir, wherein the oil reservoir is located below the filter screen.

9. The integrated stove according to claim 1, wherein the heating assembly further comprises:

a base, wherein the air duct is located in the base, and the housing is connected to the base; and a panel fastened above the base, including an opening in communication with the air duct.

10. The integrated stove according to claim 1, further comprising:

a flue assembly connected to the housing.

* * * * *